US008935841B2

(12) United States Patent
Kelly

(10) Patent No.: US 8,935,841 B2
(45) Date of Patent: Jan. 20, 2015

(54) PURSE AND METHOD OF MANUFACTURE OF SAME

(76) Inventor: Kathy A. Kelly, Erie, PA (US)

( * ) Notice: Subject to any disclaimer, the term of this patent is extended or adjusted under 35 U.S.C. 154(b) by 442 days.

(21) Appl. No.: 13/073,288

(22) Filed: Mar. 28, 2011

(65) Prior Publication Data

US 2011/0232812 A1 Sep. 29, 2011

Related U.S. Application Data

(60) Provisional application No. 61/318,425, filed on Mar. 29, 2010.

(51) Int. Cl.
*A45C 1/02* (2006.01)
*A45C 5/02* (2006.01)

(52) U.S. Cl.
CPC ... *A45C 1/02* (2013.01); *A45C 5/02* (2013.01); *Y10S 428/9033* (2013.01)
USPC ..... 29/401.1; 150/106; 150/130; 428/903.3

(58) Field of Classification Search
CPC ..... A45C 1/02
USPC ..... 150/106, 127, 130; 112/475.01; 428/903.3; 29/401.1; 281/34
See application file for complete search history.

(56) References Cited

U.S. PATENT DOCUMENTS

| | | | | | |
|---|---|---|---|---|---|
| 2,523,129 | A * | 9/1950 | Maier | 294/138 |
| 3,866,647 | A * | 2/1975 | Tarkowski | 150/104 |
| 3,964,529 | A * | 6/1976 | Brod | 150/100 |
| 4,036,417 | A * | 7/1977 | Traphagan | 294/138 |
| 4,154,275 | A | 5/1979 | Cauley | 150/85 |
| 4,795,194 | A * | 1/1989 | Etheredge | 281/34 |
| 5,588,196 | A * | 12/1996 | Samelson | 29/401.1 |
| 6,880,221 | B2 | 4/2005 | Sprenger | 29/428 |
| 7,178,568 | B2 * | 2/2007 | Wynona | 150/129 |
| 2006/0032875 | A1 * | 2/2006 | Patterson | 224/153 |
| 2006/0225603 | A1 * | 10/2006 | Anderson et al. | 105/127 |
| 2007/0083973 | A1 * | 4/2007 | Garniewicz | 2/81 |

* cited by examiner

*Primary Examiner* — Sue A Walker
(74) *Attorney, Agent, or Firm* — Robert M. Bauer

(57) ABSTRACT

The present invention is directed to an article of manufacture and method of manufacture relating to purses, handbags, wallets and the like. The method disclosed herein relates to utilizing text book covers off of books, such as legal treatises and case law books as the primary material for such articles. The text book cover is removed, cleaned, prepared, cut, sewn and glued together to form a purse, handbag, wallet and the like. The result of the disclosed invention is eco-friendly as it takes an old, often discarded item and forms a highly useful and quite stylish "new" article.

3 Claims, 13 Drawing Sheets

PURSE AND METHOD OF MANUFACTURE OF SAME

CROSS-REFERENCE TO RELATED APPLICATIONS

The present application claims the benefit of U.S. Provisional Application No. 61/318,425 filed on Mar. 29, 2010, which is incorporated herein by reference.

FEDERALLY SPONSORED RESEARCH

Not Applicable

BACKGROUND OF THE INVENTION

1. Field of the Invention

The field of the present invention encompasses reusing and/or recycling the covers off of old text books by utilizing said material as the primary material for a purse, hand bag, wallet or change purse.

2. Description of Related Art

It is well known throughout the world that females, and to a much lesser extent males, carry with them purses, change purses, wallets, handbags and the like to hold various personal items and accoutrements that may be needed when a person leaves their abode. These bags are not only functional, but are often fashionably designed with costs anywhere from as low as a few dollars up to thousands of dollars, depending on the type of purse, the style and the manufacturer. There are millions of different types of purses made from all types of materials, including, but in no way limited to leather, suede, polyester, plastics, fabrics, rubber, etc. They range in size from small to extra large, depending on various needs of the purchaser.

Recently, there has been a worldwide movement for articles of use to be more "green", i.e. more environmentally friendly by being manufactured from previously used materials so as not to increase the amount of trash generated by our society. This green movement looks for new and novel ways to reuse and recycle manufactured goods rather than simply placing them in landfills. Purchasers of green products have the added benefit of feeling good about such a purchase as aiding the long-term well-being of our planet.

Text books, including, but not limited to, legal treatises and case law books used to be stocked and updated by most law firms, legal libraries and public libraries. Since the advent of electronic research, usage of such a cumbersome and expensive mode of research has been in great decline. Currently there is a need to dispose of a large amount of law books. Simply recycling the paper is a helpful alternative, but the covers, which are frequently quite ornate and made from fabric leather and other expensive materials led to the present invention, which utilizes the covers off of old text books as the primary material for purses, handbags, wallets and the like.

BRIEF SUMMARY OF THE INVENTION

The within invention is a novel use of the disposable covers by utilizing them as materials to make purses, handbags wallets and the like. This keeps in line with the "green" movement and ultimately provides the ultimate user with a highly fashionable and unique bag that can be used daily and yet purchased at a reasonable cost.

BRIEF DESCRIPTION OF THE DRAWINGS

These and other features, aspects and advantages of the present invention will become better understood with regard to the following description, appended claims, and accompanying drawings where:

FIG. 1-A is a cross section view of a generic text book cover titled "Title" with the interior portion of the book removed showing the front hard cover, spine, and back hard cover of the book comprised of cardboard material and flexible outer cover material.

DETAILED DESCRIPTION OF THE INVENTION

Article of Manufacture

Figure 3:
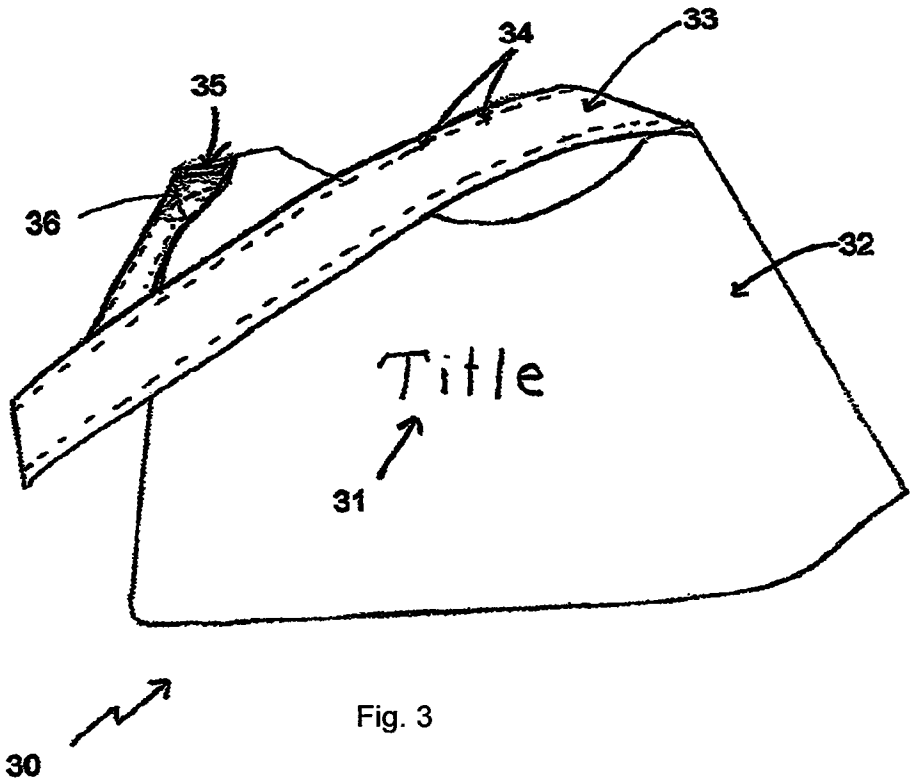
FIG. 3 is a perspective view of a purse made from a book cover with the generic title "Title".
Figure 4:
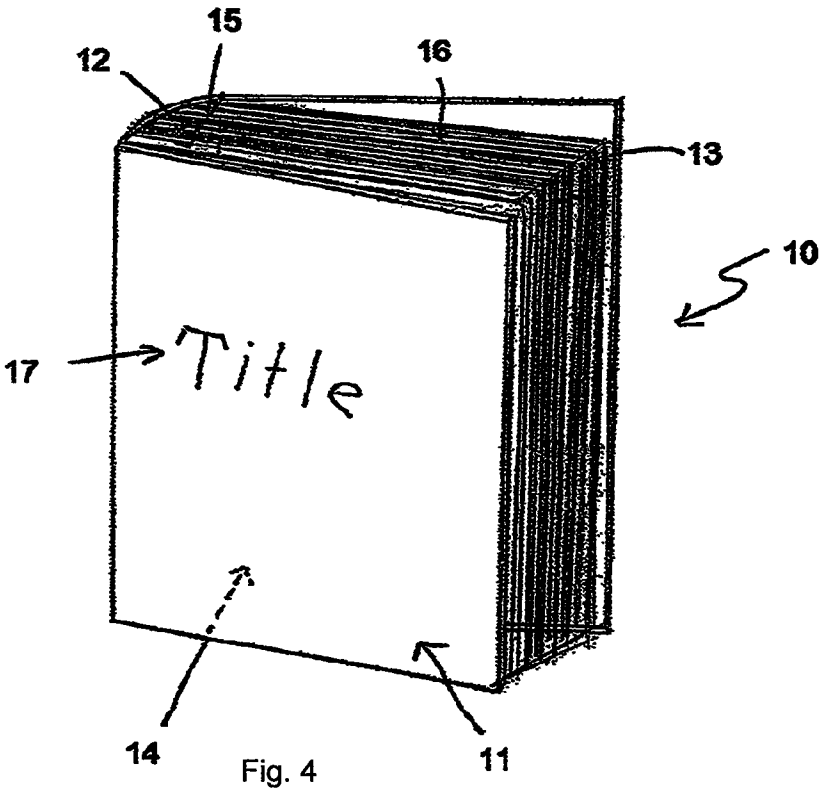
FIG. 4 is a perspective view of a generic text book containing an interior portion comprised of book contents.
Figure 5:
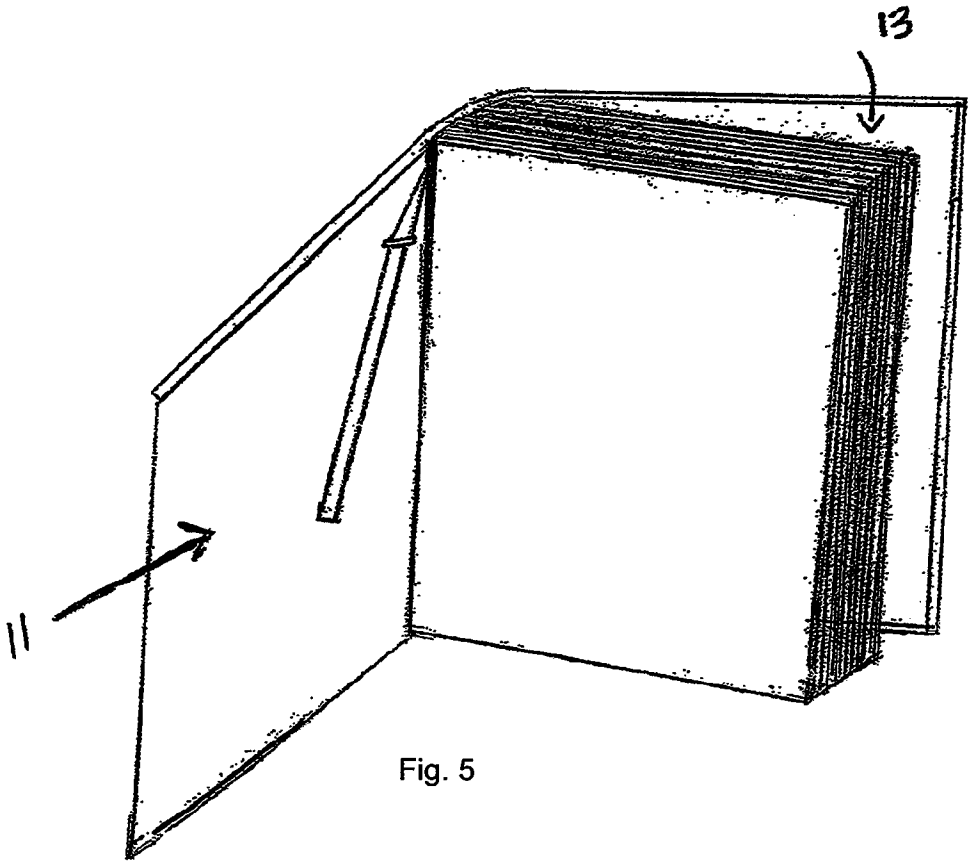
FIG. 5 is a perspective view of removing the interior portion comprised of book contents via cutting.

This invention encompasses many different types and styles of purses, including, but not limited to flat bags with a string shoulder strap, large purses, smaller and medium sized purses as well as wallets and change purses, all being manufactured from the covers of text books. The term "purse" will be used herein to encompass all types of purses, handbags, wallets and the like as contemplated herein. A purse with a preferred embodiment is shown in FIG. 3.

One improvement to make the purse stronger is to iron a fusible interlacing material to the back side of the cover material.

Method

Figure 1:
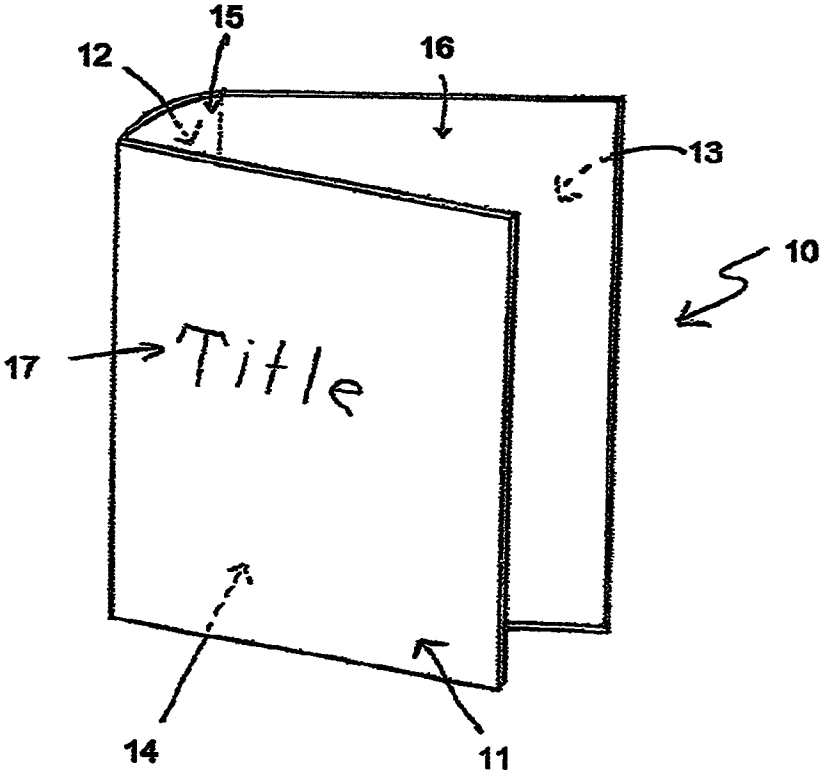
FIG. 1 is a perspective view of a generic text book cover, titled "Title", with the interior portion of the book removed.
Figure 1A:
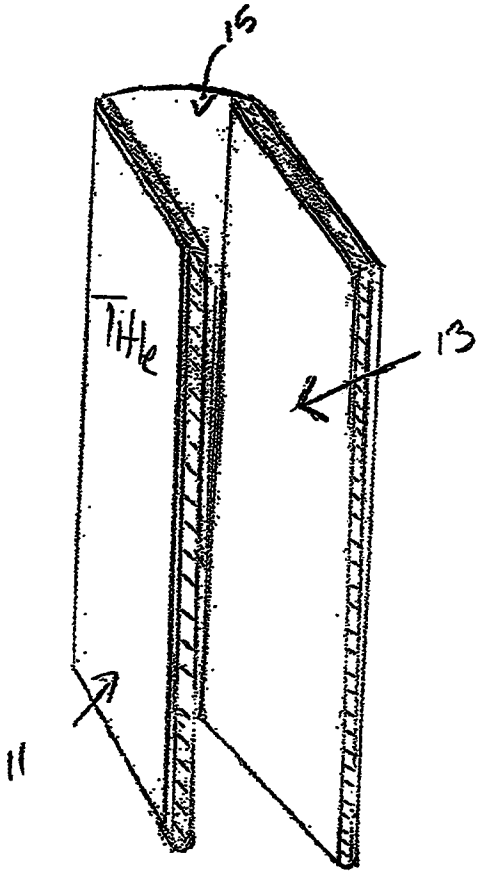
FIG. 1B is a perspective view of a generic text book cover titled "Title" showing the peeling back of the flexible outer cover material from the front hard cover, spine, and back hard cover.
FIG. 1C is a perspective view of a generic text book cover titled "Title" showing the washing of the cover material.
FIG. 1D is a perspective view of a generic text book cover titled "Title" showing the drying of the cover material.
FIG. 1E is a perspective view of a generic text book cover titled "Title" showing the attachment of fusible interfacing to the outer cover material.
FIG. 1F is a perspective view of a generic text book cover titled "Title" showing the cutting of the cover material into pieces.
FIG. 1G is a perspective view of the cover material being sewn together to make a purse.
FIG. 1H is a perspective view showing turning the pouch inside-out so that the outer cover material face with the fusible interface material is on the inside of the pouch.
Figure 1B:
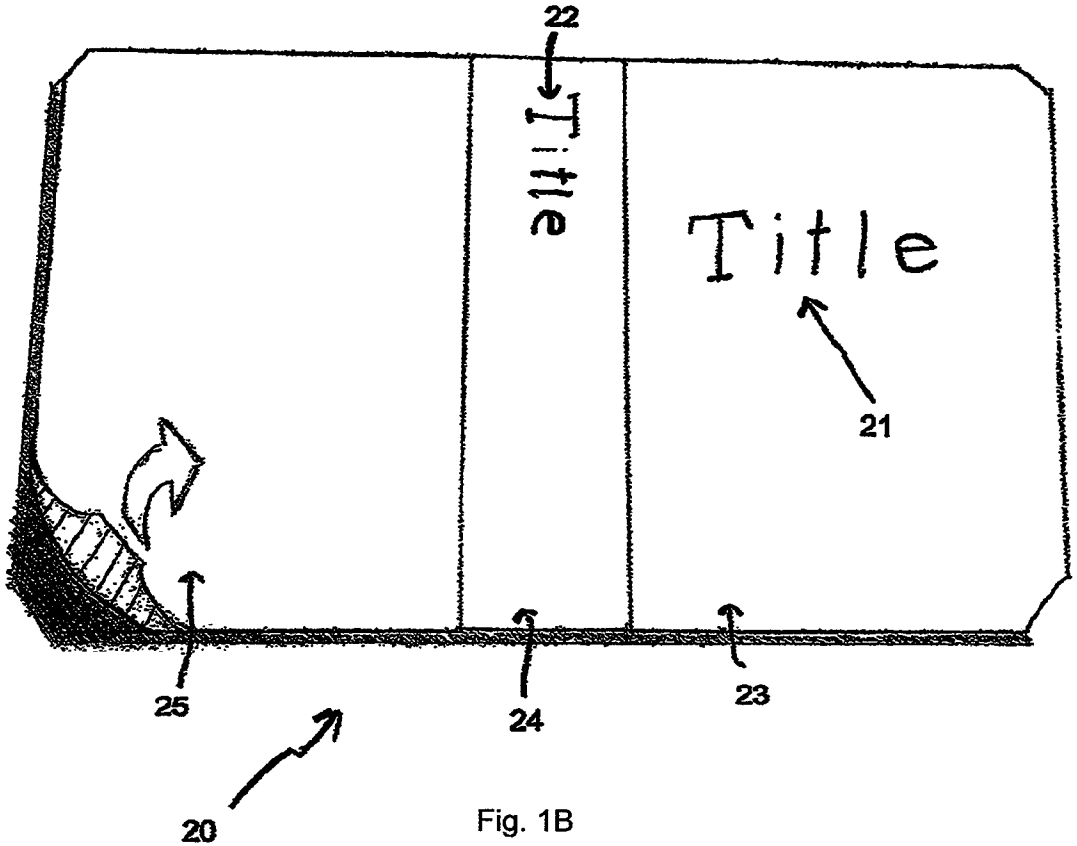
Figure 1C:
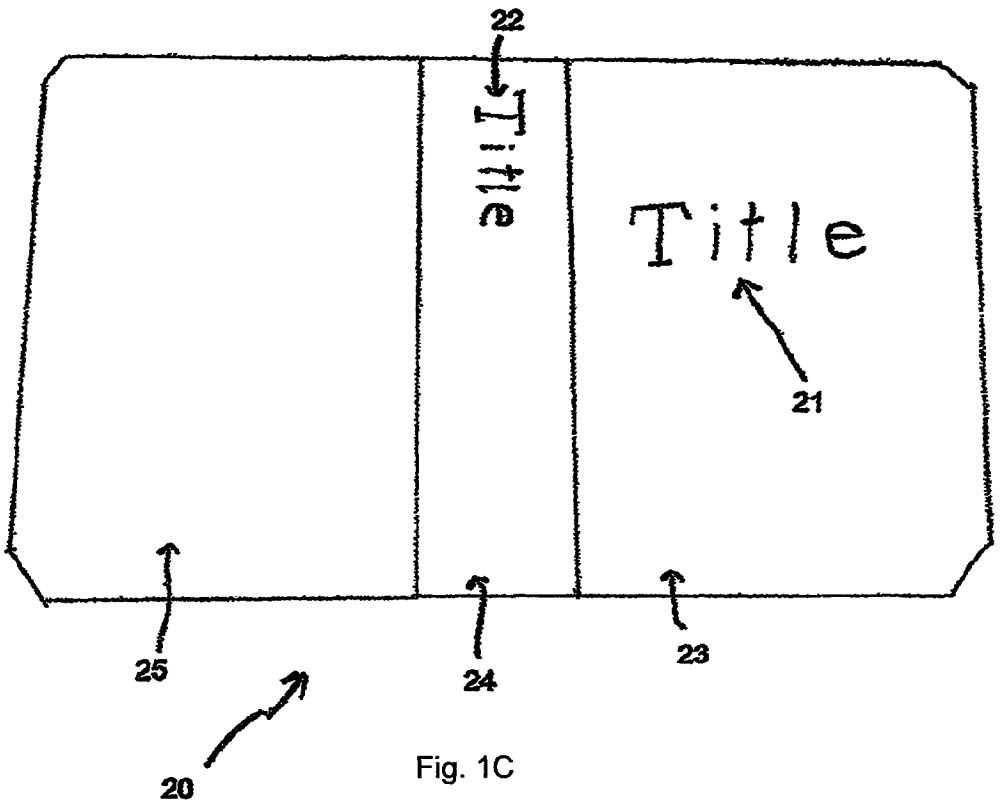
Figure 1D:
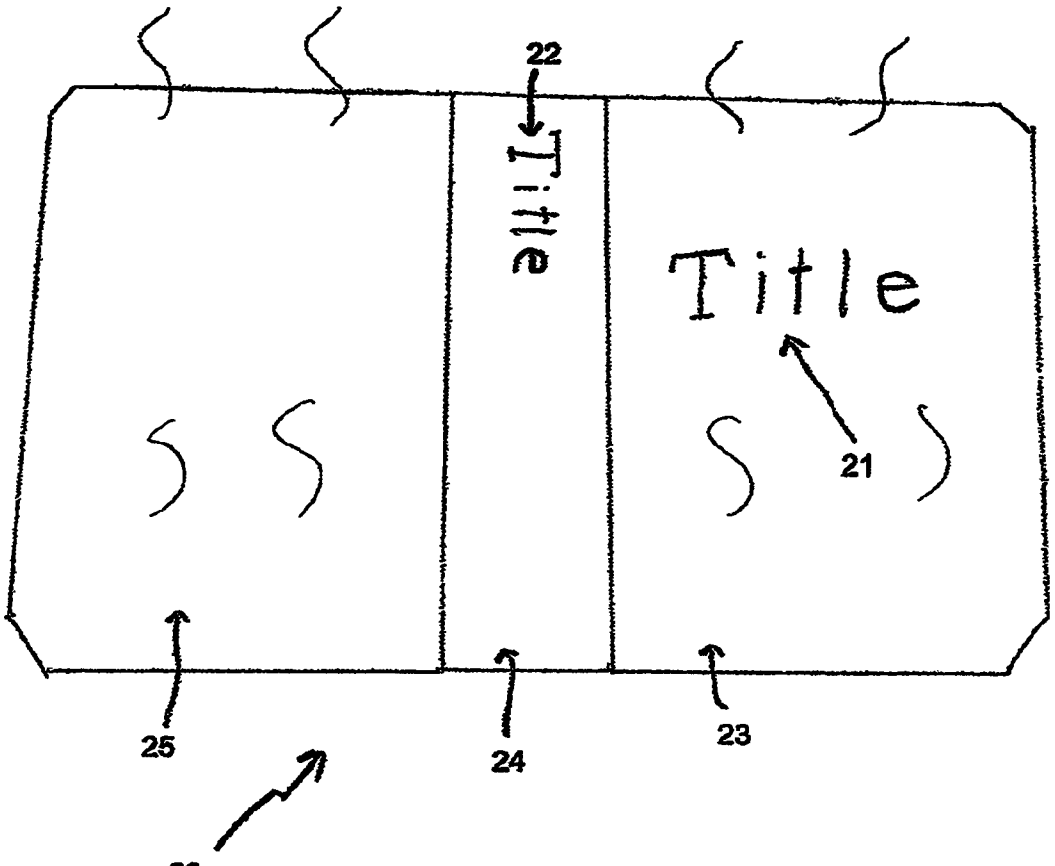
Figure 1E:
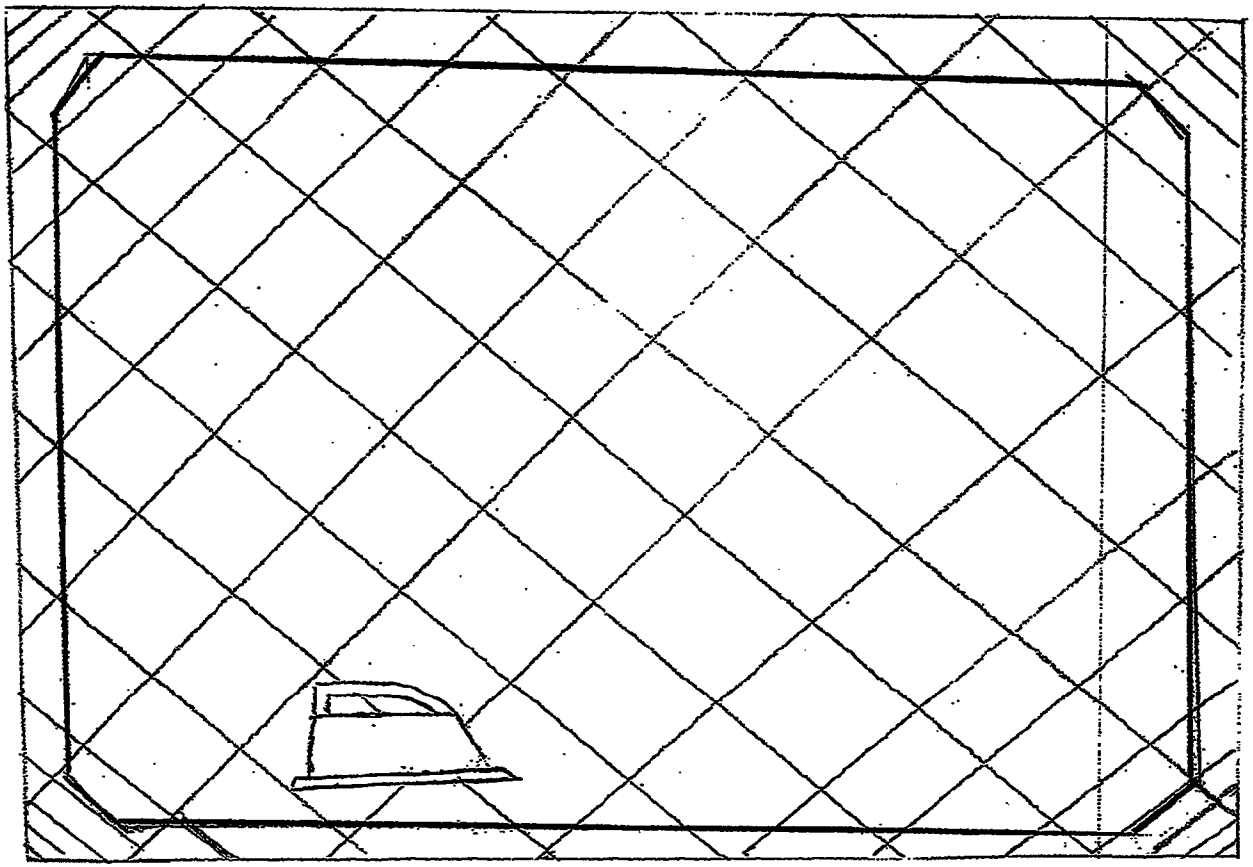
Figure 1F:
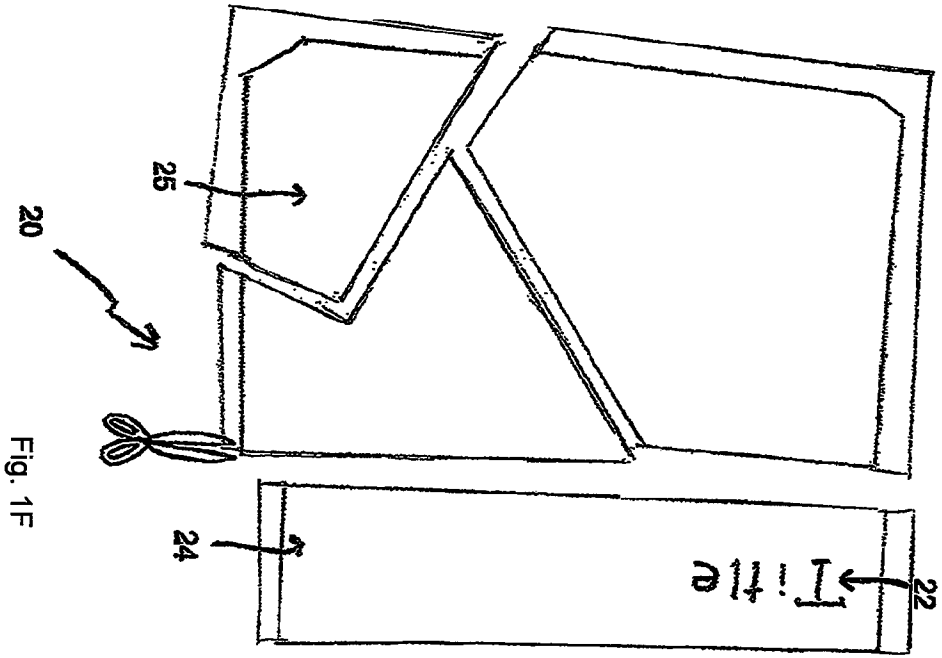
Figure 1G:
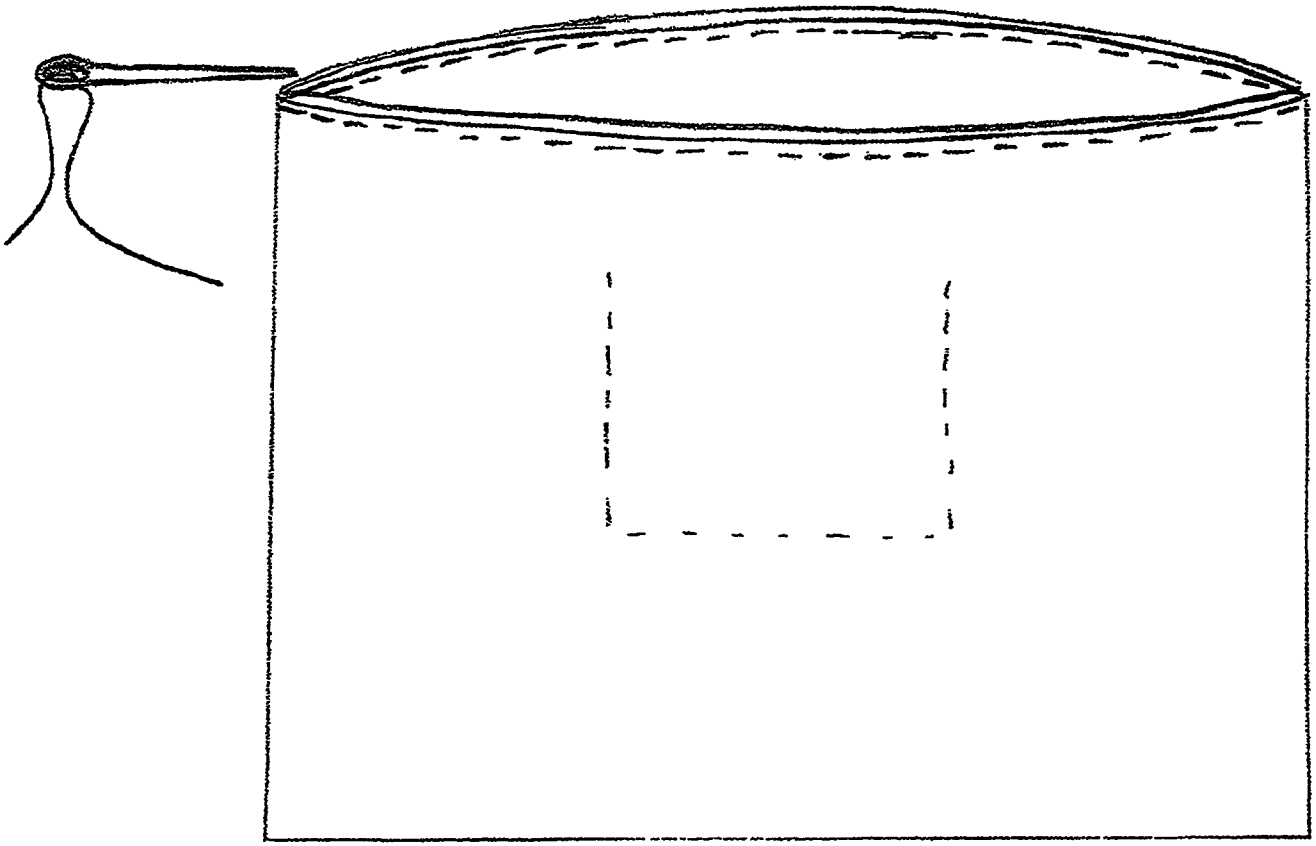
Figure 1H:
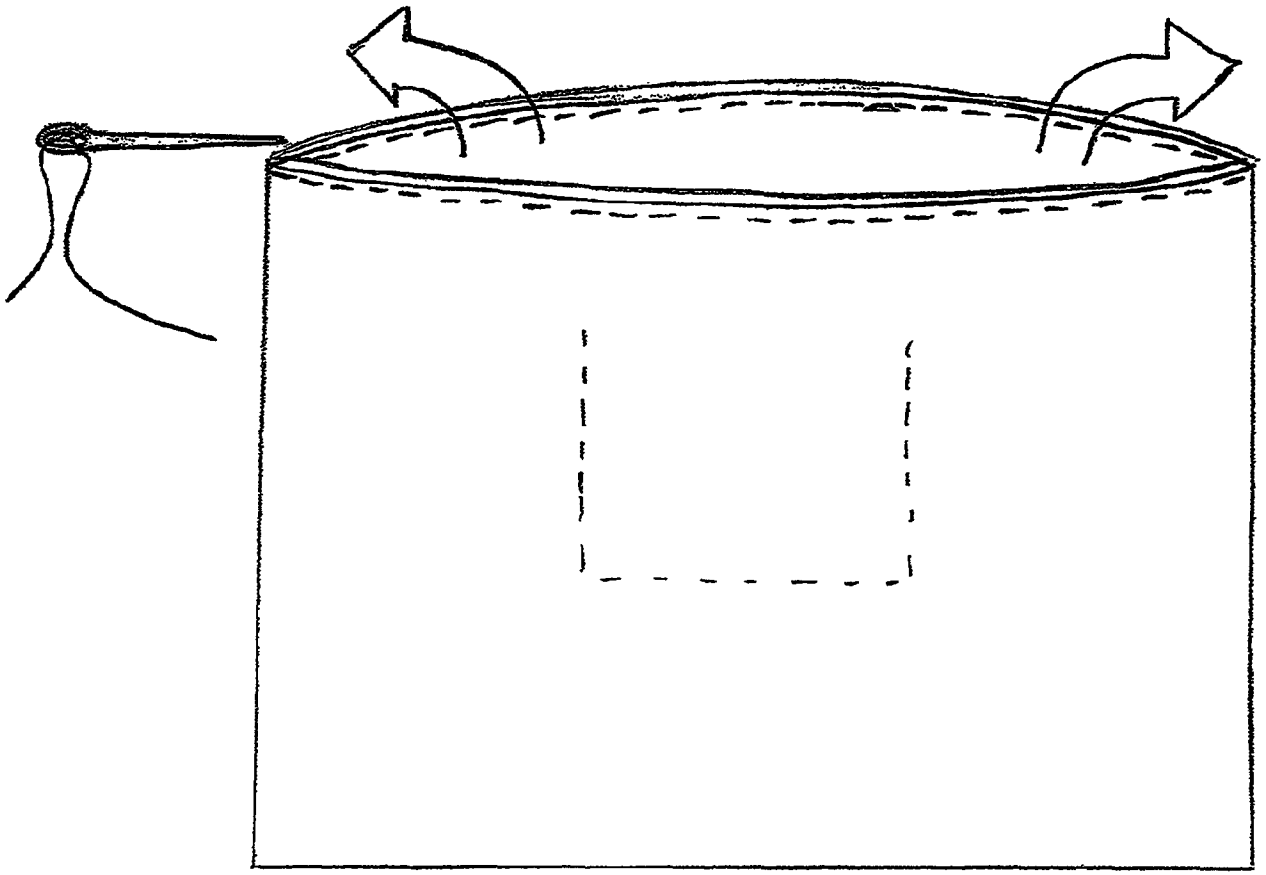
Figure 2:
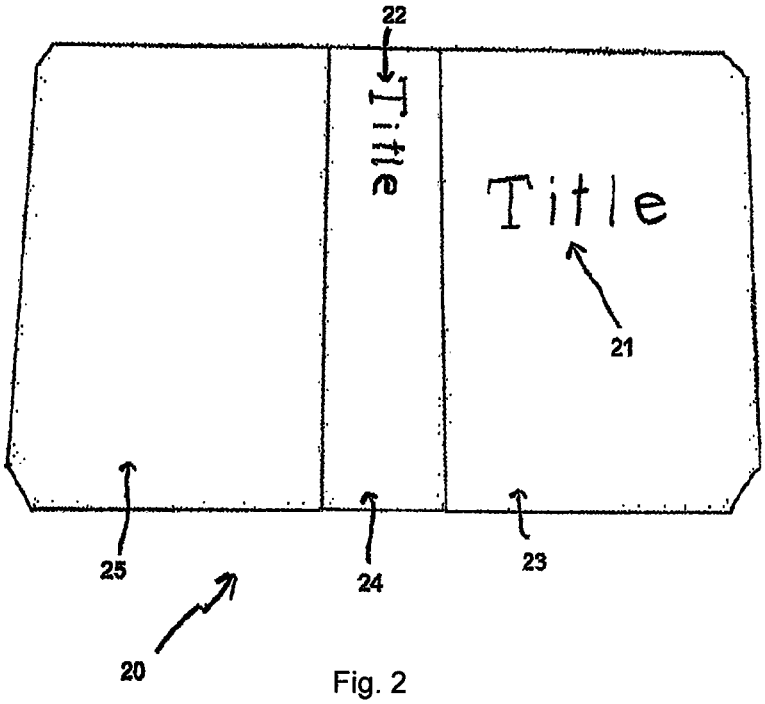
FIG. 2 is a perspective view of a generic text book cover titled "Title" after the cover has been separated from the backing and cleaned.

First, remove the cover from a hard-cover text book by cutting out the contents of the book at the first and last bound page as in FIG. 1. FIG. 1 shows the book with a title 17, a front hard cover 11 attached to a spine 12 which is attached to a hard back 13. Removal of a backing material affixed to the top hard cover on the back side of the front hard cover 14, the spine 15, and the back side of the back hard cover 16. The next step would be to carefully peel back the outer cover material of the front 11, spine 12 and back 13 parts of the book (which may be leather, linen, plastic, leather-like or similar material)

from the cardboard portions of the book cover front 14, spine 15 and back 16 as in FIG. 1. Washing the leather to remove any remaining cardboard, paper glue, binding and the like to get a clean piece of material is the next step in the process. Once the material has dried, the piece of raw material 20 as shown in FIG. 2, is regularly between 16 to 17 inches by 10 to 11 inches in size. FIG. 2 shows the front page title 21 on the front page 23, the spine title 22 on the spine 24 and a blank back cover area 25.

Once the cover has dried, a fusible interface may be ironed to the inner surface of the raw material. The cuts made to the dried book cover depend on the type of books being used as well as the part of the cover being used for the purse. Sometimes, the spine of the book is undesirable for use as a material to make the purse. When this occurs, the spine is simply cut away from the raw material and discarded and the purse is then made utilizing the remaining raw materials.

For other purses, the spine is desirable and frequently two book covers will need to be used to provide the materials. To use two book covers for a single purse, two to three inches are cut off of the raw material shown in FIG. 2. This leaves a large piece of material to be used to form the front and back panels of the purse.

The raw material 20 can now be cut and sewn to make a purse 30 as shown in FIG. 3. The purse 30 shows the title of the book 31 and is made up of a pouch area 32 for storing items. There is a shoulder strap 33 made from the raw material 20 that contains stitching 34, a strong cross-stitch area 36 which holds the strap 33 to the purse pouch area 32 via a clasp 35.

A detailed method for one embodiment of the present invention contemplates placing two book covers with their "outer covers" facing each other and stitching down the sides and across the bottom thereof. These seams need to be double stitched. Open the pouch now formed and pinch the right sides together at the corner so that the seams are aligned and form a point. A straight line is then sewed across said point, forming a triangle. This is repeated for the other corner making sure both triangles are the same size. Next, the triangles are cut off, making a straight line edge at the corner.

The material is now turned inside-out to form a pouch that has the book cover artwork on the outside. A liner for the purse needs to be formed by cutting two large squares that are slightly smaller than the original front and back panels that form the outside of the pouch. A small square is formed for a pocket. Using a no-sew, iron-on hem tape, all four sides of the pocket are turned inwards and ironed onto the center of one of the larger liner squares. The pocket is then stitched on the sides and at the bottom. A double stitch is used when added strength is needed.

The liners are then turned to face each other and a stitching is performed down the sides and about three inches from both sides on the bottom, leaving a large opening at the bottom of the liner. The liner is opened and the sides are pinched together at the corner so that the seams are aligned and form a point. A straight line is sewn across the point, which forms a triangle. This is repeated on the other corner, making sure that both triangles are the same size. The triangles are cut off, making a straight line edge at the corner.

Next, two long, even strips of leather (or other book cover material) plus one long strap that will wrap around the mouth of the shell is formed from the raw material. The two even strips are aligned such that the "outer cover" material is facing each other, which is then stitched together down the long sides of the material, leaving both ends open. This strap is then turned inside-out by pulling one end through the other until only the "outer cover" side is showing. A border is stitched approximately ⅛ inch down the length of the strap, which serves as the shoulder strap for the purse. The single strap is placed around the mouth of the shell with the "outer cover" facing each other. These are basted together.

The shell is then put into the liner, with the "outer cover" sides facing each other. Stitching is performed down the outer side of the liner to the outer side of the strap that is basted onto the shell. Next, the basted stitches are removed from between the mouth of the shell and the leather strap, only at the sides where the strap will be connected. The strap is aligned with the outside seam of the shell and is basted in place. The leather strap is double stitched to the shell, with extra stitching at the shoulder strap intersection.

The liner and leather strip are flipped into the purse. The magnetic closures are aligned and fastened to the leather strip. All seams are glued, as are the inside panels of the shell, and a heavy glue is used at the inside leather strip. The bottom liner is stitched closed and the liner is pressed into the glued panels until smooth. Front and back panels are pressed with cardboard or similar material may be added for increased rigidity. The entire purse is then hung to dry for 12 to 24 hours.

From the descriptions above, a number of advantages of the purse become evident:

1. A purse made from recycled book material is unique and environmentally friendly;
2. Provides an avenue for using materials that are usually just thrown out or recycled in a manner that does not keep the original form of the book cover intact; and,
3. A purse made with known book covers makes a fashion statement to those who use it.

While the description above refers to particular embodiments of the present invention, it will be understood by those skilled in the art that many modifications may be made and equivalents may be substituted without departing from the spirit thereof. The accompanying claims are intended to cover such modifications as would fall within the true scope and spirit of the present invention. The disclosed embodiments are therefore to be considered as illustrative and not as restrictive. The scope of the invention is defined by the appended claims.

I claim:

1. A method of manufacturing a purse comprising:

(a) cutting out the contents of a hard cover book at the first and last pages so that said hard cover book contains a front hard cover attached via a spine to a back hard cover, said front hard cover, spine, and back hard cover comprised of a cardboard material all covered by a flexible outer cover material, said flexible outer cover material having an inside flexible outer cover material face attached to the cardboard material and an outside flexible outer cover material face containing a textual or design feature;

(b) peeling back the flexible outer cover material carefully from the cardboard material to obtain one large piece of flexible outer cover material;

(c) washing the flexible outer cover material to remove any remaining contaminants;

(d) drying the flexible outer cover material;

(e) attaching a fusible interface material to the inside flexible outer cover material face;

(f) cutting the flexible outer cover material into pieces;

(g) sewing and gluing said pieces to form a pouch so that the inside flexible outer cover material face with the fusible interface material is on the outside of the pouch; and (h) turning the pouch inside-out so that the inside flexible outer cover material face with the fusible interface material is on the inside of the pouch.

2. The method of claim 1 wherein a liner is added to the inside of the pouch.

3. The method of claim 1 wherein a shoulder strap is attached to the pouch.

* * * * *